United States Patent [19]

Rajewski

[11] Patent Number: 4,854,855

[45] Date of Patent: Aug. 8, 1989

[54] FLARE IGNITER ASSEMBLY

[76] Inventor: Robert C. Rajewski, P.O. Box 2247, Stettler, Alberta, Canada, T0C 2L0

[21] Appl. No.: 169,779

[22] Filed: Mar. 18, 1988

[51] Int. Cl.[4] ..... F23D 13/20

[52] U.S. Cl. ..... 431/202; 431/258

[58] Field of Search ..... 431/202, 258, 263, 264

[56] References Cited

U.S. PATENT DOCUMENTS

| | | | |
|---|---|---|---|
| 4,579,522 | 4/1986 | MacDonald | 431/202 |
| 4,711,629 | 12/1987 | MacDonald | 431/202 X |

FOREIGN PATENT DOCUMENTS

| | | | |
|---|---|---|---|
| 763761 | 7/1967 | Canada | 158/90 |
| 781249 | 3/1968 | Canada | 158/82 |
| 929847 | 7/1973 | Canada | 158/15 |
| 1054508 | 5/1979 | Canada | 158/8 |
| 1089662 | 11/1980 | Canada . | |

*Primary Examiner*—Larry Jones

*Attorney, Agent, or Firm*—Body, Vickers & Daniels

[57] ABSTRACT

A flare igniter assembly comprises an elongated tubing assembly including a first air supply conduit and a fuel gas supply line enclosed inside of said first air supply conduit. The fuel gas supply line is provided with a member having a venturi-type orifice through which fuel gas and intake air pass, the orifice effectes initial mixing of fuel gas and air. The fuel gas supply line further includes a combustion zone and means for transferring a fuel gas-air mixture downstream from the orifice to the combustion zone. The combustion zone includes an inspirating baffle member firmly positioned within the fuel gas supply line. The baffle member is so constructed as to effect further thorough mixing of the fuel-gas mixture as it passes therethrough prior to combustion of the mixture in combustion zone. The system also includes a terminal portion inclined at an angle relative to the remainder of the fuel gas supply line and a second air supply conduit extending parallel to the first air supply conduit and in juxtapositiion therewith. The terminal portion of the fuel gas supply line extend into the second air supply conduit within which an ignited flame is burning. The second air supply conduit is provided with a port hole in the wall opposite to the terminal portion of the igniter and adjacent to a corresponding port hole in the flare stack near the upper end thereof when the assembly is in operative position such as to enable flame from the terminal portion to pass therethrough to ignite combustible waste gases passing through the flare stack.

22 Claims, 5 Drawing Sheets

FLARE IGNITER ASSEMBLY

The present invention pertains to a burner for gaseous fuel and more particularly pertains to a structure which provides for mixing gas supplied at low pressures with air in such a manner that the mixture moves in one general direction to induce additional air to move into the presence of the burning fuel whereby the mixture burns stably to provide a pilot type burner for kindling gas escaping through the upper end of a flare stack and to provide a pilot type burner which is stable in operation at significant elevations above the surrounding terrain and maintains ignition of the flare stack.

It is a common practice in industries where hydrocarbons and other inflammable materials are processed to dispose of some of the gaseous materials by burning. The combustion of such gases is normally carried out in the atmosphere and at significant elevations above grade levels and at the top of a flare stack. Wind currents and other weather conditions tend to make it difficult to maintain ignition of the gases at the upper end of such stacks. Pilot type burners have been employed for such purposes and the structure disclosed in Canadian Patent No. 763,761 to Robert Reed shows the combination of a pilot burner and a flare stack. The combination comprises a flare stack, a generally erect tube adjacent the upper end of said stack, a pipe in communication with and depending from the tube and having an open lower end disposed below the upper end of said stack. The system has a tubular member within the tube providing an annular space between the interior of the tube and the exterior of the tubular member and means for guiding gas under pressure into the said annular space. The tubular member has a plurality of circumferentially spaced ports therethrough with their axes converging downstream and towards the axis of the tubular member whereby the gas jets moving therethrough mingle, thus providing an "energy resultant" moving upwardly within the tubular member providing a sub-atmosphere pressure thereby inducing air to move into said tubular member from the pipe and mix with said gas. The combination has means for igniting the gas and air mixture for burning within said tube above the tubular member, and the tube has apertures therethrough for admitting limited quantities of air into the tube.

This known structure has a number of disadvantages, for instance, in this system the igniter mixes air and a fuel at the top of the igniter close to the flame and thus pulls in a certain amount of air from the stack tip from port 36. This could pull in contaminated air and a buildup of carbon or sludge could affect the operation of the igniter. The Reed igniter is fixed to the stack tip and does not move; it is lit from ground level by a flame front that travels to the igniter through a pipeline.

The object of the present invention is to avoid disadvantages of known systems and to provide a stable flame for a stack igniter.

Other and further objects and features of the invention will be appreciated and become apparent to those skilled in the art as the disclosure proceeds and upon consideration of the accompanying drawings and the following detailed description wherein an embodiment of the invention is disclosed.

Broadly the present invention comprises a flare igniter assembly comprising:

an elongated tubing assembly of relatively non-corrodible metal which, when in operative position, is in juxtaposition with the exterior wall of a vertically extending flare stack; said assembly including:

a first air supply conduit;

a fuel gas supply line enclosed within of said first air supply conduit;

said fuel gas supply line being provided with a member having a venturi-type orifice through which fuel gas and intake air pass, said orifice effecting initial mixing of said fuel gas and air;

said fuel gas supply line further including a combustion zone;

means for transferring a fuel gas-air mixture downstream from said orifice to said combustion zone; said combustion zone including an inspirating baffle member firmly positioned within said fuel gas supply line downstream of said orifice; said baffle member being so constructed as to effect further thorough mixing of said fuel-gas mixture as it passes therethrough prior to combustion of said mixture in said zone; and a terminal portion inclined at an angle relative to the remainder of said assembly;

a second air supply conduit extending parallel to said first air supply conduit and in juxtaposition therewith;

said terminal portion of said igniter extending into said second air supply conduit within which an ignited pilot flame is burning;

said second air supply conduit being provided with a port hole in the wall opposite to said terminal portion and adjacent to a corresponding port hole in said flare stack near the upper end thereof when said assembly is in operative position such as to enable flame from said terminal portion to pass therethrough to ignite combustible waste gases passing through said flare stack;

said second air supply conduit being provided for supplying said combustion zone with an additional amount of air and for protecting the flame of said terminal parties against strong wind and pollutants;

said flare stack igniter assembly being of sufficient length to ensure that air drawn into said first and second air supply conduits is substantially uncontaminated with waste gases and pollutants from said flare stack; and said igniter assembly being retractable from a first, operative position parallel to and in juxtaposition with said flare stack near the upper end thereof, to a second position at the base of said flare stack, and vice versa.

In another embodiment the igniter assembly of the present invention is provided with a hot air exhaust conduit forming a continuation of said second air supply conduit and provided for transferring the hot air from said pilot flame.

In a further embodiment the flare stack igniter assembly also includes tracking attached to the exterior wall of the flare stack and extending vertically therealong, said assembly being slidably movable vertically from said first to said second positions and vice versa along said tracking.

The flare stack igniter assembly is provided with a pre-heater flame assembly provided with a second orifice which supplies air and fuel gas to a pre-heater flame.

In a preferred embodiment, the baffle member has a configuration approximating an Archimedean screw but having three lobes contacting the inner walls of said short length of tubing near one end thereof, at each of at least two spaced apart points therealong.

In still another embodiment the present invention comprises:

a flare pit igniter assembly adapted for manual ignition of a fuel gas-air mixture, having the general characteristics of the flare stack igniter assembly defined above but wherein:

(1) said igniter assembly is attached to and positioned parallel to and in juxtaposition with a generally horizontally extending boom which is pivotally mounted on an upright support member; and (2) said assembly is of greater length than that of said flare stack igniter assembly.

In yet another embodiment the present invention comprises a flare igniter assembly adapted for ignition inside of the burner tubes having the general characteristics of the above mentioned flare stack igniter assembly, but with the following differences:

(1) said igniter assembly is attached to and positioned parallel to and in juxtaposition with a burner tube; and (2) said assembly is provided with a down draft deflactor plate for directing pilot flame towards said burner.

BRIEF DESCRIPTION OF THE DRAWINGS

Referring now to the drawings, FIGS. 1–3 show a stack igniter assembly 10 movably attached to a flare stack 12 by means of tracking 14. The stack igniter assembly 10 comprises an elongated tubing assembly which when in operative position is in juxtaposition with the exterior wall 16 of a vertically extending flare stack 12. The assembly 10 comprises a first air supply conduit 18 in which is enclosed a fuel gas supply line 20. The fuel gas supply line 20 is provided with an orifice assembly or member 22 associating the fuel gas supply line 20 with the first air supply conduit 18 by means of a venturi-type orifice through which fuel gas and air from conduit 18 are passed, the orifice effecting initial mixing of said fuel gas and air. The orifice assembly 22 is sealed off inside of conduit 18 at the end so that when the igniter assembly is in an operative position it stops fluids created from condensation of the heated air from running down from the ignitor. The igniter assembly 10 further includes a combustion zone 24 and means for transferring a fuel gas-air mixture downstream from the orifice of member 22 to the combustion zone 24, such as a transfer tube 26 made of substantially non-corrodible metal. This transfer tube 26 is provided with a heat shield (not shown) to deflect the heat. The combustion zone 24 further includes an igniter nozzle tip 28 connected to the opposite end of the transfer tube 26. Igniter nozzle tip 28 comprises a short length of tubing of substantially non-corrodible metal within which is firmly secured a baffle or ignitor inspirating member 30 so constructed as to effect further thorough mixing of said fuel gas-air mixture prior to combustion.

Figure 1:
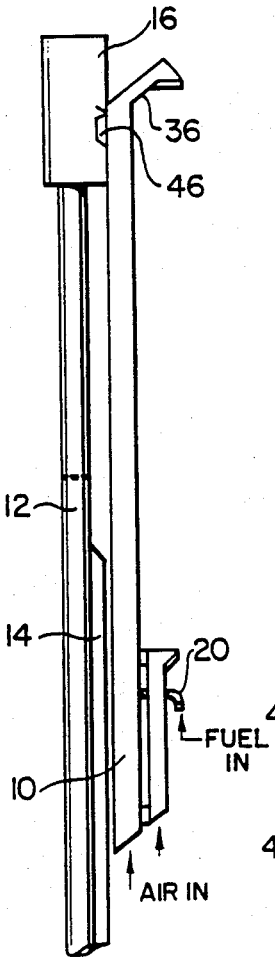
FIG. 1 is a fragmentary side elevational view of the upper end portion of a flare stack illustrating a stack igniter assembly embodying the invention in association therewith.
Figure 3:
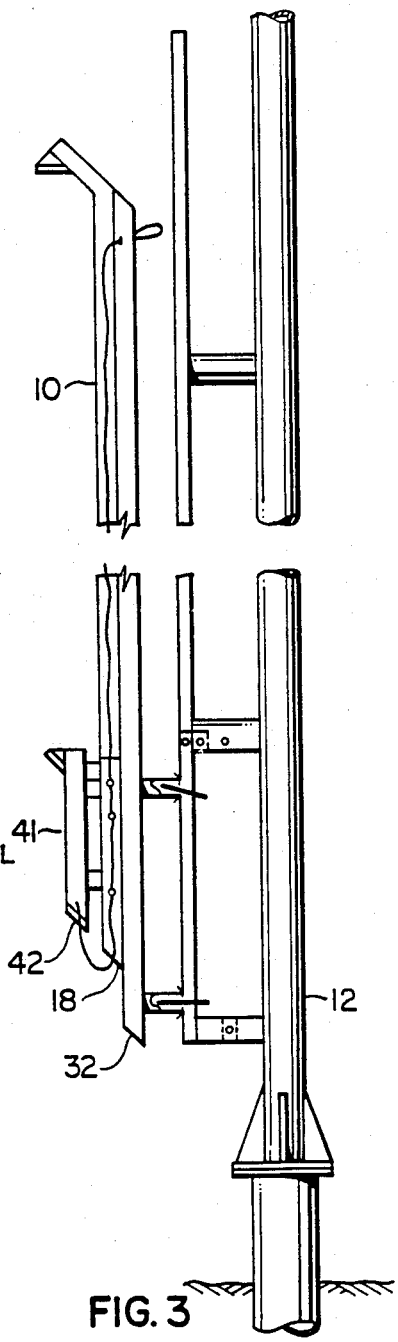
FIG. 3 is a side elevation of the base portion of a flare stack with the stack igniter assembly in a lowered position.
Figure 2:
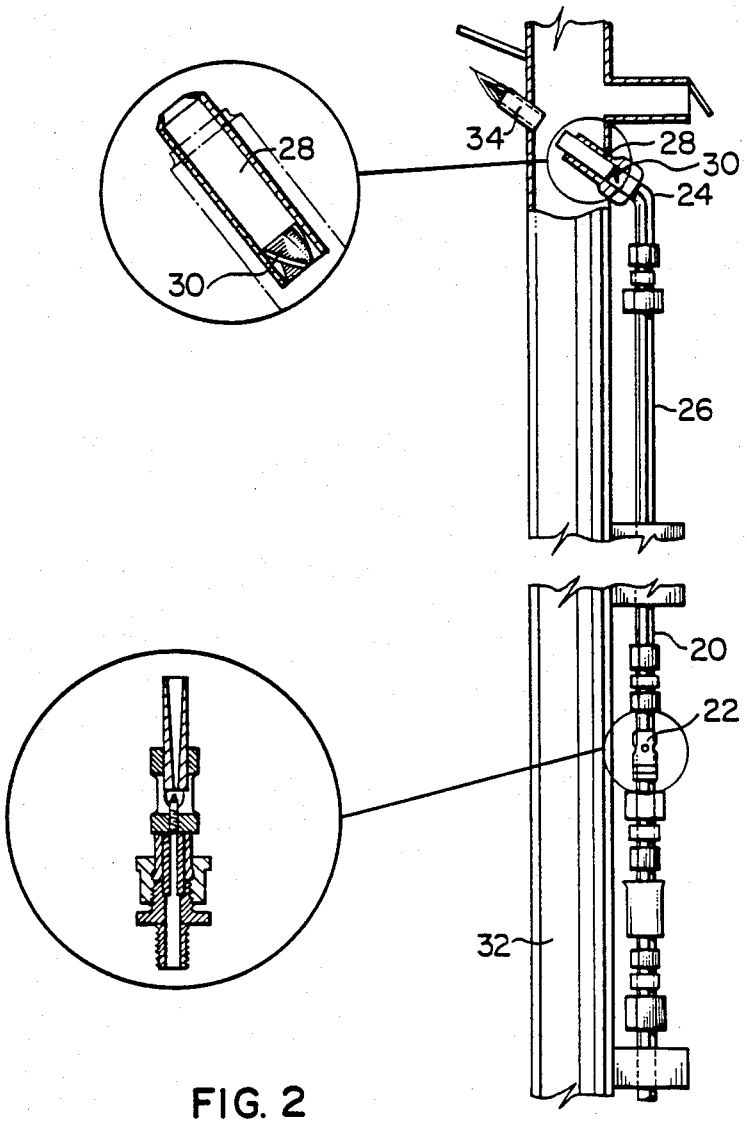
FIG. 2 is a view on a larger scale illustrating portions of the stack igniter assembly structure in section.
Figure 4:
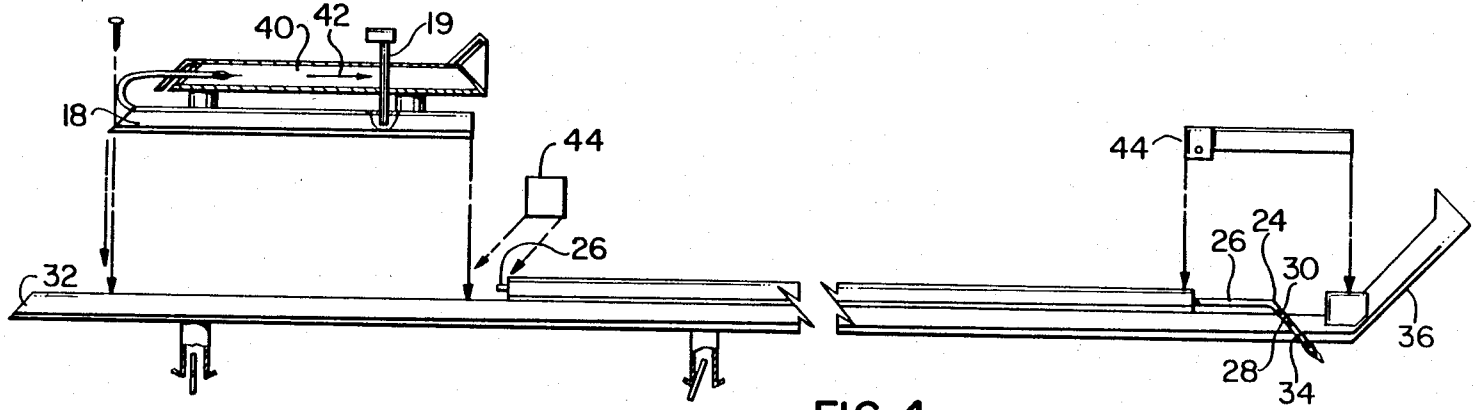
FIG. 4 is a side elevation of the stack igniter assembly provided with a pre-heater according to the one embodiment of the invention.

Preferably, the baffle member 30 has a configuration approximating an Archimedean screw but having three lobes contacting the inner walls of the short length of tubing near one end thereof, at each of at least two spaced apart points therealong.

The igniter nozzle inspirating tip 28 is one of the most important parts of the igniter. This tip is used both for the pilot flame and the pre-heater flame. The pilot flame burns very strongly and it is very wind resistant. The nozzle tip has a baffle member 30 of stainless steel machined to fit the required tubing size. There are 3 grooves machined in the sides at a 45° angle. This small piece or baffle member 30 of machined stainless steel is then pushed a certain distance in from the end of the tube and then crimped in place so it cannot move. When the air and gas mixture is forced through these spirals it causes more air to be drawn in and then it burns in the tubing, the combination of the tubing and spiral baffle acting as a nozzle. Without this feature the igniter would *not* work.

The terminal portion of ignitor nozzle tip 28 is inclined at an angle relative to the remainder of the assembly 10. The assembly 10 also is provided with a second air supply conduit 32 extending parallel to the first air supply conduit 18 and in juxtaposition thereto.

The terminal portion of said igniter nozzle tip 28 extends into the second air supply conduit 32 within which an ignited flame is burning.

The second air supply conduit 32 is provided with a port hole 34 in the wall opposite to the terminal portion of nozzle tip 28 and adjacent to a corresponding port hole in the flare stack near the upper end 16 when said assembly is in operative position such as to enable flame from nozzle tip 28 to pass therethrough to ignite combustible waste gases passing through the flare stack.

The second air supply conduit 32 is provided for supplying of nozzle tip 28 with an additional amount of air and for also serving to protect the flame of the nozzle tip against strong wind and pollutants.

This allows the pilot flame to remain stable if the port hole 34 is blocked off for any reason. When the blockage is removed the pilot flame can then resume burning through the port hole 34.

The terminal end of nozzle tip 28 and port hole 34 of the second air supply conduit 32 are spaced apart a certain distance.

The main purpose for this spacing is to allow the pilot flame to burn in a totally separate area, these areas being the pilot area and waste gas area. The only communication between the pilot area and the waste gas area is the ¼" port hole 34. The pilot flame shoots through the port hole 34 to the waste gas area where the pilot flame comes in contact with waste gas and ignition occurs.

The port hole 34 is sized so that it takes very high velocity winds to extinguish the pilot flame. The reason for this is that once the wind breaks through the port hole to the pilot area it loses velocity because it has been dispersed into a much larger area.

The flare stack igniter assembly 10 is of sufficient length to ensure that air drawn into the first and second air supply conduits 18, 32 is substantially uncontaminated with waste gases and pollutants from the flare stack. Assembly 10 is retractable from a first operative position parallel to and in juxtaposition with the flare stack 12 near the upper end thereof, to a second position at the base of the flare stack, and vice versa.

The second air supply conduit 32 is provided with a hot air exhaust conduit 36 forming a continuation of said second air supply conduit 32 and provided for transferring the hot air from the pilot flame.

The tracking 14 is attached to the exterior wall of flare stack 12 and extends vertically therealong, the assembly 10 being slidably movable vertically from first to second positions and vice versa along tracking 14. The ignitor assembly is locked in operative position by means of a stainless steel wedge (not shown) so that any heat distortion is eliminated. This is a benefit of the present system to provide stability of the ignitor under any conditions.

The flare stack igniter assembly 10 includes means as described hereafter for retracting the assembly from the first position to the second position and vice versa.

The igniter is retractable to ground level to enable the igniter to be lit, inspected and maintained with ease and savings. The igniter slides up and down the length of the flare stack on "T" style tracking 14 made in one piece with all sides open so that buildup on the tracking is minimized. This tracking is spot welded to the flare stack 12 and helps reinforce the stack. The igniter is pulled up and down by hinge means or by a ¼" stainless steel cable and a pulley mounted on a stainless steel pin, with a hand or electric winch.

In a preferred embodiment the stack igniter is constructed of square tubular stainless steel, and the length of the igniter is about 10 feet. This allows the pilot tips to draw fresh air from well below the heat and pollutants coming from the top of the flare stack.

Figure 5:
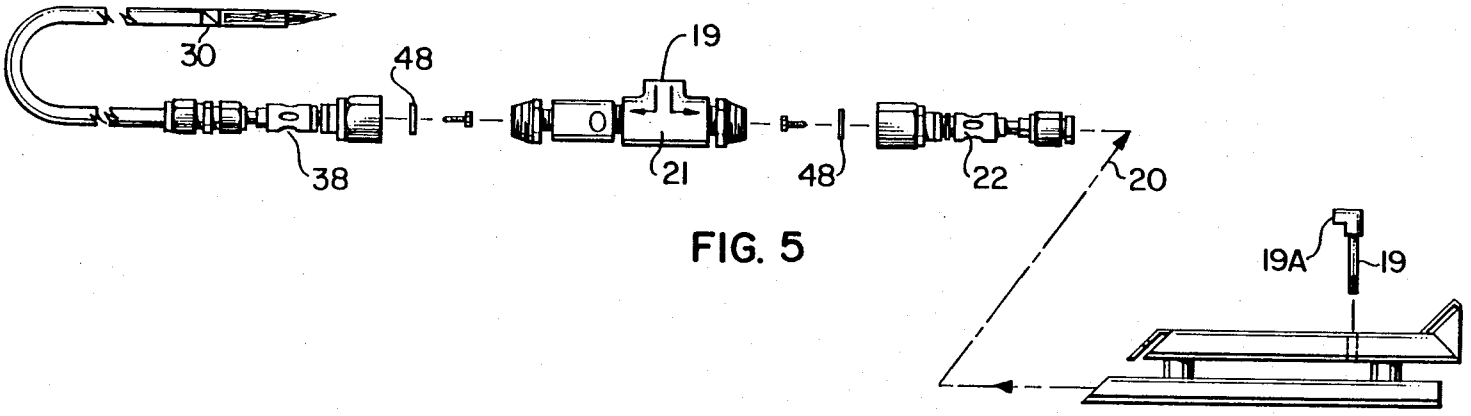
FIG. 5 is a view on a larger scale illustrating portions of the stack igniter shown on FIG. 4.

The flare stack igniter assembly 10 is provided with a pre-heater or torch assembly 40 having an orifice 38 as shown in FIG. 5 which supplies air and fuel gas to a pre-heater flame tip 41 which is provided with a baffle member similar to the pilot flame member 30.

The assembly 10 also includes a pre-heater tube 42 connected to the pre-heater or torch assembly and within which the pre-heater flame burns, said pre-heater tube 42 being arranged so as to supply heat to incoming fuel gas passing from the fuel inlet line 19A via nipple 19 located within pre-heater tube 42.

The igniter assembly 10 preferably is constructed from 2"×2" 0.120 wall square stainless steel tubing. The stainless steel grades can be altered to suit the customer. The length of the igniter can also be adjusted to suit the customer's needs.

The igniter preferably is constructed from stainless steel so that there is no corrosion of the igniter resulting from $H_2S$ or weather. It is built compactly and is easy to handle.

The lower part of first air supply conduit tube 18 and the pre-heating tube 42 are spaced 1" apart from each other and welded so that they are in one piece when removed from the igniter frame.

The igniter assembly is built so that no fluids or dirt can enter the tubes unless it comes in the air intake at the bottom, which is not normal.

The pre-heating tube 42 contains the heat coming from the pre-heater flame so it can be conducted into a ¼" pipe nipple 19 located within the tube 42 and carrying incoming fuel, and also shields the flame from wind and weather.

The orifices and transfer tubes can be altered for different types of fuel.

The igniter may be built with slides and keepers so it will travel up and down tracking.

Under very severe $H_2S$ conditions the area around the pilot can be more sturdily constructed and different types of stainless steel can be used to prolong the life of the housing.

Orifice member 38 supplying air and fuel gas to the pre-heater pilot flame 40 is provided with a shut-off valve (not shown) used during the summer season. The tubes of assembly 10 are preferably made of stainless steel construction.

Flare stack igniter assembly 10 is attached to the exterior wall of the flare stack 16 by a plurality of brackets 44 at spaced apart intervals along the length of the assembly.

The flare stack igniter assembly includes a shield 46 (FIG. 1) attached to the exterior wall of the second air supply conduit 32 around the port hole 34, said shield 46 being of a shape corresponding to the shape of the exterior wall of the flare stack 16. This shield 46 stops any air flow from hitting the pilot exit port and deflects any kind of wind, particularly a side wind blowing into the pilot port.

The diameter of port hole 34 of second air supply conduit 32 is substantially less than the pilot flame burning inside of the second air supply conduit to prevent any penetration of pollutants or strong wind into the second air supply conduit to extinguish the pilot flame.

The igniter assembly 10 has a length of approximately 10 feet. The fuel inlet line 19A is made of a hose made of flexible material.

Each lobe of baffle member 30 contacts the inner wall of the short length of tubing at approximately a 45° angle, the tips of the lobes being seated in grooves formed in the inner wall of said tubing.

The orifice members 22 and 38 additionally are provided with one or more filters 48 for particulate material.

Preferably said filters 48 are positioned upstream of said torch orifice assembly and made of paper.

Filters 48 are used to filter out any dirt or metal particles. Filters play an important role in the orifice assembly to make the system work better.

The orifice members 22 and 38 are of venturi-style. The size of orifice can be altered as desired. The fuel gas preferably is propane but any fuel gas may be used. The air intake pipes 18 and 32 supply the pilot with clean air, and a space for the pilot flame to burn in so that if the port hole 34 is blocked off the pilot flame will burn normally.

The hot air exhaust 36 provides for venting of hot air and burned gases from the pilot flame and also stops the gases from blowing back onto the pilot flame. This gives the pilot a totally undisturbed area to burn in. The ignition of the waste gas is caused by the pilot burning through the port hole 34.

As previously stated, the inspiring or baffle member 30 consists of non-corrodible metal machined at a 45° angle. As the air-fuel mixture passes through the member 30 it is spun around, drawing in additional oxygen, then burning in a small portion of the tube. This device allows for a very stable and fuel efficient pilot flame.

Igniter assembly 10 uses both natural gas and propane fuel to supply a constant pilot. This system uses a very small volume of fuel and supplies a very strong source of ignition pilot. The system is very simple compared to the electrical systems used now and requires very little maintenance thus cutting the cost to the consumer substantially.

The system mixes very small amounts of air and fuel through a simple orifice that is in the four thousands of an inch range. Also the present system can feed stable amounts of air and fuel into the igniter tip at all times without temperature change, and this makes the igniter very stable under any flaring rate, high or low, that is coming from the stack.

The areas the pilots burn in are protected from disturbances. The igniter has no moving parts to wear out and uses inexpensive orifice style fuel metering. These orifices are double filtered to prevent any particles from blocking fuel supply.

The fuel is supplied to the igniter with a flexible rubber and nylon wrapped hose or a flexible stainless steel hose, whichever the user prefers. The hose is held in place on the tracking by hose guides that slide up and down the tracking with the igniter.

Figure 6:
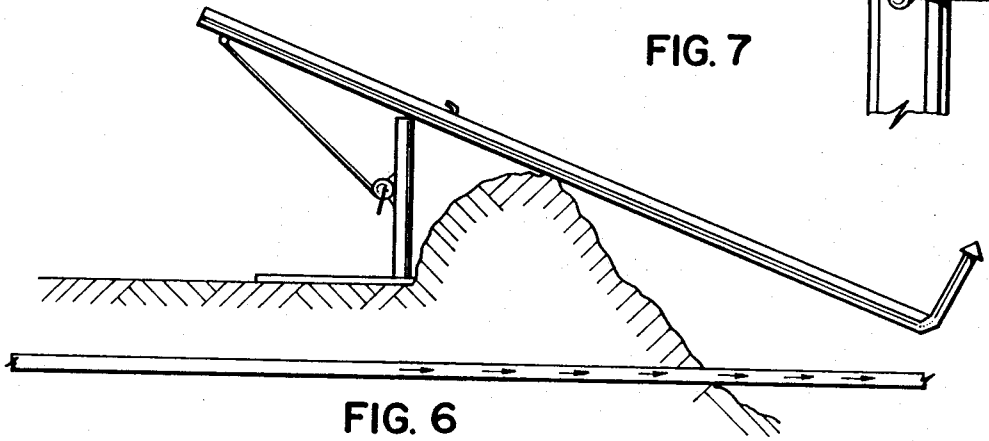
FIG. 6 is a side elevation of a flare pit igniter according to another embodiment of the present invention.

The flare pit igniter shown in FIG. 6 is constructed in the same manner and has the same characteristics as the stack igniter 10 previously described but is designed for a pit. The same orifice and pre-heater assembly from the stack igniter previously described is used on the pit igniter. However, the frame of the pit igniter is much longer to enable the pilot tip to reach the gases but also draw fresh air to the orifices from outside the fire wall of the pit. The hot air exhaust pipe is inclined at a different angle to remove burnt air from the pilot flame. The long boom is set on a pivoting device so the igniter can be removed from the pit for maintenance or lighting.

The pit igniter is retractable, 20' to 25' long, with a pivoting point towards the end that the igniter is mounted. This enables the pit igniter to reach out a long distance into the flare pit but still draw fresh air from outside the fire wall. The pit igniter is provided with a hand winch to raise and lower the boom, thus enabling the igniter to swing out of the pit for lighting or maintenance. With this system the igniter can be positioned easily. The fuel consumption is similar to that of the stack igniter.

Figure 7:
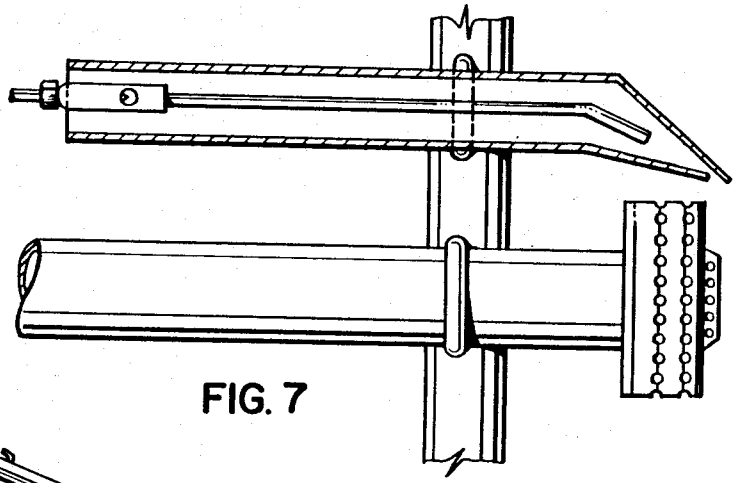
FIG. 7 is a side elevation of a burner tube pilot according to another embodiment of the present invention.
Figure 8:
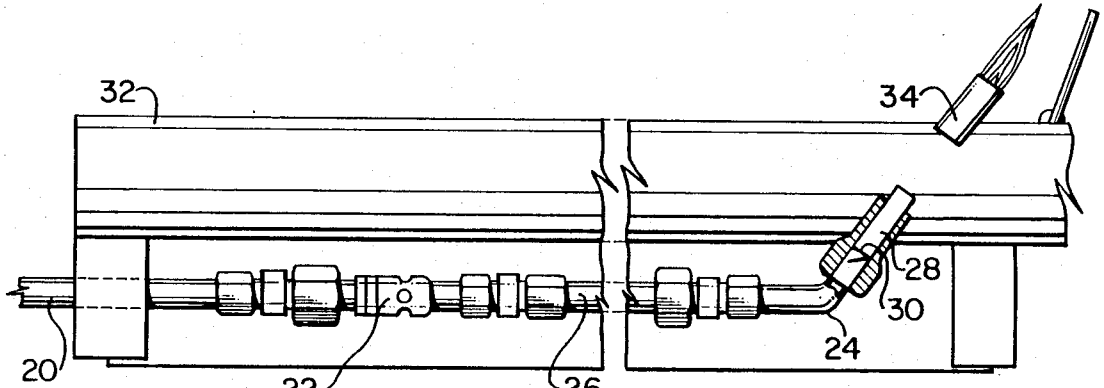
FIG. 8 is a fragment of the side elevation shown in FIG. 7.

The burner tube pilot is shown in FIGS. 7 and 8. These types of pilots are designed to supply a constant source of ignition inside the burner tubes of treaters, line heaters, dehydrators, etc. They will remain stable under the most severe wind conditions, thus minimizing the cost for down time, steamers, hot oilers, and maintenance crews. The burner tube pilot's estimated fuel consumption is 50,000 $ft^3$/year for fuel gas, and 170 gallons/year for propane.

The configuration of the burner tube pilot is very similar to the pre-heating assembly of the stack igniter shown in FIGS. 1 to 5. It comprises an air-fuel orifice assembly 22, a transfer tube 26, and a combustion nozzle 24.

The igniter tip 28 is also burning inside of an air supply conduit 32 and comes out of this conduit 28 through an outlet port 34. The system is positioned along the burner tubes and is provided with a down draft deflector plate for directing a pilot flame towards the burner head.

In operation the flare stack igniter assembly 10 works as follows:

Fuel is supplied to the igniter assembly 10 through a flexible hose (fuel inlet line 19A) that raises and lowers with the igniter. The igniter and hose travel up and down the stack on tracking 14.

Once the fuel reaches the igniter it travels through a ¼" pipe nipple 19 to a T-shaped member 21. The T-shaped member 21 divides the flow into two directions supplying the two separate orifices with fuel. One orifice 22 supplies air and fuel to the pilot used to ignite the waste gas. The other orifice 38 supplies air and fuel to the pre-heater flame tip 41. This pre-heater flame burns inside the pre-heater tube 42 at the base of the igniter. As the pre-heater flame burns the heat rises and is conducted onto the ¼" pipe nipple 19 that is carrying the incoming fuel. The heat that is conducted onto the ¼" pipe nipple 19 helps vaporize gases and keeps ice from building up on the air inlets or orifices. The pre-heater orifice 38 has a valve that can be shut off in the summer or in warm climates.

The air and fuel that is going to the igniter flame is carried down the transfer tube 26 to the igniter flame inspirating tip or igniter nozzle tip member 28 where it burns in the air intake tube 32.

As the fuel gas-air mixture burns in this tube the hot, burnt air from the flame rises upwards and is vented out the hot air exhaust tube 36 and as the hot air is rising it also pulls in fresh air from the base of the igniter to the pilot tip so there is always oxygen to burn. This prevents the pilot flame from being smothered by burnt gases from the stack tip.

As the pilot flame burns in the air intake tube 32 it shoots a small portion of the flame through a ¼" port hole 34 in the side of the tube that the pilot flame is shooting against. This small portion of flame that is shooting through ignites the waste gases in the flame stack. Because the ¼" port hole 34 is smaller than the pilot flame that is burning in the air intake tube, the flame that is shooting out of the port hole prevent entry of any gases or liquids or pollutants into the air intake tube thus maintaining a stable flame inside the air intake tube. Should the ¼" port hole be blocked off for any reason or if there were high winds pushing against the port hole it would not affect the operation of the pilot flame inside the tube 32 because the flame is protected by the air intake tube. With this arrangement one can use a very small pilot flame and still keep it wind proof.

Optionally the system could include a thermocouple and a controller to monitor the pilot to be sure that the pilot is burning at all times. The thermocouple is housed inside of a igniter head and is positioned so that the pilot is throwing the heat on to the thermocouples, which is in turn taking heat from the pilot flame. When the pilot flame goes out, the thermocouple sends a signal to the controller and the controller in the main control room of the plant or the control panel.

The controller sends power back up the stack to the igniter to a re-ignition device that re-ignites the pilot. There also may be provided remote ignition and self ignition systems. One of the advantages of the present invention is that the propane consumption is very little—about 3 to 4 liter's in a 24 hour period—which is not matched by any known system on the market, that we are aware of.

The advantages of the present system are:

The present igniter uses a high pressure lower volume fuel supply making it more efficient and more stable.

The igniter assembly mixes air and fuel at the base of the igniter away from the intense heat that is produced from the flare tip.

The igniter is fully retractable to ground level, travelling on tracking designed for this application.

The igniter is lowered to the ground, lit manually and hoisted back to its position at the stack tip.

The present igniter meters fuel through a single hole in a venturi-style orifice.

The present igniter draws all incoming air in from the base of the igniter 12' below, supplying uncontaminated air.

The new igniter has been designed to cut the cost of fuel consumed and give a stable pilot in all conditions from no volume to high volume, in any conditions from single oil batteries, gas well stand by, large plant or refineries or in remote areas where there is minimal fuel supply.

While the invention has been described with reference to the specific structural features and with regard to a particular means for igniting the pilot burner various changes may be made. The gaseous fuel burner may be employed for purposes other than serving as a pilot for a flare stack. Such modifications and others may be made without departing from the spirit and scope of the invention as set forth in the appended claims.

The embodiments of the invention in which an exclusive property or privilege is claimed are defined as follows:

1. A flare igniter assembly, comprising:

an elongated tubing assembly of relatively noncorrodible metal which, when in operative position, is in juxtaposition with the exterior wall of a vertically extending flare stack; said assembly including:

a first air supply conduit;

a fuel gas supply line enclosed with in said first air supply conduit;

said fuel gas supply line being provided with a member having a venturi-type orifice through which fuel gas and intake air pass, said orifice effecting initial mixing of said fuel gas and air;

said fuel gas supply line further including a combustion zone;

means for transferring a fuel gas-air mixture downstream from said orifice to said combustion zone; said combustion zone including an inspirating baffle member firmly positioned within said fuel gas supply line; said baffle member being so constructed as to effect further thorough mixing of said fuel-gas mixture as it passes therethrough prior to combustion of said mixture in said zone; and a terminal portion inclined at an angle relative to the remainder of said fuel gas supply line;

a second air supply conduit extending parallel to said first air supply conduit and in juxaposition therewith;

said terminal portion of said fuel gas supply line extending into said second air supply conduit within which an ignited flame is burning when said assembly is in operation;

said second air supply conduit being provided with a port hole in the wall opposite to said terminal portion of said igniter and adjacent to a corresponding port hole in said flare stack near the upper end thereof when said assembly is in operative position such as to enable flame from said terminal portion to pass therethrough to ignite combustible waste gases passing through said flare stack;

said second air supply conduit being provided for supplying said terminal portion with an additional amount of air and for protecting the flame of said terminal portion against strong wind;

said flare igniter assembly being of sufficient length to ensure that air drawn into said first and second air supply conduits is substantially uncontaminated with waste gases and pollutant from said flare stack; and said assembly being retractable from a first, operative position parallel to and in juxaposition with said flare stack near the upper end thereof, to a second position at the base of said flare stack and vice versa.

2. A flare igniter assembly, comprising:

an elongated tubing assembly of relatively noncorrodible metal which, when in operative position, is in juxtaposition with the exterior wall of a vertically extending flare stack; said assembly including:

a first air supply conduit;

a fuel gas supply line enclosed within said first air supply conduit;

said fuel gas supply line being provided with an orifice assembly having a venturi-type orifice through which fuel gas and intake air pass, said orifice effecting initial mixing of said fuel gas and air;

said fuel gas supply line further including a combustion zone;

means for transferring a fuel gas-air mixture downstream from said orifice to said combustion zone; said combustion zone including an igniter inspirating member firmly positioned within said fuel gas supply line downstream of said orifice; said member being so constructed as to effect further thorough mixing of said fuel-gas mixture as it passes therethrough prior to combustion of said mixture in said zone; and a terminal portion inclined at an angle relative to the remainder of said assembly;

a second air supply conduit extending parallel to said first air supply conduit and in juxtaposition therewith;

said terminal portion of said igniter inspirating member extending into said second air supply conduit within which a ignited flame is burning when said assembly is in operation;

said second air supply conduit being provided with a port hole in the wall opposite to said terminal portion of said inspirating member and adjacent to a corresponding port hole in said flare stack near the upper end thereof when said assembly is in operative position such as to enable flame from said terminal portion to pass therethrough to ignite combustible waste gases passing through said flare stack;

said second air supply conduit being provided for supplying said terminal portion with an additional amount of air and for protecting the flame of said terminal portion against strong winds;

said flare stack igniter assembly being of sufficient length to ensure that air drawn into said first and second air supply conduits is substantially uncontaminated with waste gases and pollutants from said flare stack; and, said assembly being retractable from a first, operative position parallel to and in juxaposition with said flare stack near the upper end thereof, to a second position at the base of said flare stack and vice versa;

said second air supply conduit being provided with a hot gas exhaust conduit forming a continuation of said second air supply conduit and provided for transferring the hot gas from said pilot flame.

3. A flare stack igniter assembly according to claim 1 or claim 2 and including tracking attached to the exterior wall of said flare stack and extending vertically therealong, said assembly being slidably movable vertically from said first to said second positions and vice versa along said tracking.

4. A flare igniter assembly according to claim 1, 2 or 3 wherein the diameter of said port hole of said second air supply conduit is substantially less than the pilot flame burning inside of said second air supply conduit to prevent any penetration of pollutants or strong wind into said second air supply conduit to extinguish said pilot flame.

5. A flare igniter assembly according to claim 1 or claim 2 and including means for retracting said assembly from said first position to said second position and vice versa.

6. A flare igniter assembly according to claim 1 or claim 2, further comprising a hinge means for lowering said assembly to ground level from said second position.

7. A flare igniter assembly according to claim 1, further comprising a pre-heater assembly and including a pre-heater tube connected to said pre-heater assembly and within which a pre-heater pilot flame burns, said pre-heater tube being arranged so as to supply heat to fuel gas incoming to said fuel gas supply line.

8. A flare igniter assembly according to claim 2 or claim 7 wherein said tubes are of stainless steel construction.

9. A flare igniter assembly according to claim 1 wherein said baffle member has a configuration approximating an Archimedean screw but having three lobes contacting the inner walls of a portion of said fuel gas supply line in said combustion zone near one end thereof, at each of at least two spaced apart points therealong.

10. A flare igniter assembly in accordance with claim 9 wherein each lobe of said baffle member contacts the inner wall of said portion of said fuel gas supply line in said combustion zone at approximately a 45° angle, the tips of said lobes being seated in grooves formed in said inner wall of said portion.

11. A flare igniter assembly according to claim 1 or 2, further including a shield attached to the exterior wall of said second air supply conduit around said port hole, said shield being of a shape corresponding to the shape of the exterior wall of said flare stack.

12. A flare igniter assembly according to claim 1 or claim 2 wherein said assembly is attached to the exterior wall of said flare stack by a plurality of brackets at spaced apart intervals along the length of said assembly.

13. A flare igniter assembly according to claim 1 or claim 2, said assembly having a length of approximately 10 feet.

14. A flare igniter assembly according to claim 1 or 2 wherein said orifice is additionally provided with a filter means for particulate material.

15. A flare igniter assembly according to claim 14 wherein said filter means is positioned upstream of said venturi-type orifice.

16. A flare stack igniter assembly according to claim 2, comprising a pre-heater assembly provided with a second orifice which supplies the air and fuel gas fixture to a pre-heater flame.

17. A flare igniter assembly in accordance with claim 16, wherein said orifice supplying air and fuel gas to said pre-heater flame is provided with a shut-off valve.

18. A flare igniter assembly adapted for ignition of waste gases coming from a pit flare line, said assembly comprising:

an elongated tubing assembly of relatively noncorrodible metal, attached to and positioned parallel to and in juxtaposition with a generally horizontally extending boom which is pivotally mounted on an upright support member, said assembly including:

a first air supply conduit;

a fuel gas supply line enclosed within said first air supply conduit;

said fuel gas supply line being provided with a member having a venturi-type orifice through which fuel gas and intake air pass, said orifice effecting initial mixing of said fuel gas and air;

said fuel gas supply line further including a combustion zone;

means for transferring a fuel gas-air mixture downstream from said orifice to said combustion zone; said combustion zone including an inspirating baffle member firmly positioned within said fuel gas supply line; said baffle member being so constructed as to effect further thorough mixing of said fuel-gas mixture as it passes therethrough prior to combustion of said mixture in said zone; and a terminal portion inclined at an angle relative to the remainder of said fuel gas supply line;

a second air supply conduit extending parallel to said first air supply conduit and in juxtaposition therewith;

said terminal portion of said fuel gas supply line extending into said second air supply conduit within which an ignited flame is burning when said assembly is in operation;

said second air supply conduit being provided with a port hole in the wall opposite to said terminal portion of said igniter assembly and adjacent to a corresponding port hole in said pit flare line when said assembly is in operative position such as to enable flame from said terminal portion to pass therethrough to ignite combustible waste gases passing through said pit flare line;

said second air supply conduit being provided for supplying said terminal portion with an additional amount of air and for protecting the flame of said terminal portion against strong wind;

said flare igniter assembly being of sufficient length to ensure that air drawn into said first and second air supply conduits is substantially uncontaminated with waste gases and pollutants from said pit flare line;

said assembly being retractable from a first operative position to a second inoperative position to enable servicing and/or light thereof, and vice versa.

19. A flare igniter assembly adapted for ignition of waste gases coming from a pit flare line, said assembly comprising:

an elongated tubing assembly of relative noncorrodible metal, attached to and positioned parallel to and in juxtaposition with a generally horizontally extending boom which is pivotally mounted on an upright support member, aid assembly including:

a first air supply conduit;

a fuel gas supply line enclosed within said first air supply conduit;

said fuel gas supply line being provided with an orifice assembly having a venturi-type orifice through which fuel gas and intake air pass, said orifice effecting initial mixing of said fuel gas and air;

said fuel gas supply line further including a combustion zone;

means for transferring a fuel gas-air mixture downstream from said orifice to said combustion zone; said combustion zone including an igniter inspirating member firmly positioned within said fuel gas supply line downstream of said orifice; said member being so constructed as to effect further thorough mixing of said fuel-gas mixture in said zone; and a terminal portion inclined at an angle relative to the remainder of said assembly;

a second air supply conduit extending parallel to said first air supply conduit and in juxtaposition therewith;

said terminal portion of said igniter inspirating member extending into said second air supply conduit within which an ignited flame is burning when said assembly is in operation;

said second air supply conduit being provided with a port hole in the wall opposite to said terminal portion of said inspirating member and adjacent to a corresponding port hole in said pit flare line when said assembly is in operative position such as to enable flame from said terminal portion to pass therethrough to ignite combustible waste gases passing through said pit flare line;

said second air supply conduit being provided for supplying said terminal portion with an additional amount of air and for protecting the flame of said terminal portion against strong winds;

said flare igniter assembly being of sufficient length to ensure that air drawn into said first and second air supply conduits is substantially uncontaminated with waste gases and pollutants from said pit flare line;

said assembly being retractable from a first operative position to a second inoperative position to enable servicing and/or lighting thereof, and vice versa;

said second air supply conduit being provided with a hot gas exhaust conduit forming a continuation of said second air supply conduit and provided for transferring the hot gas from said pilot flame.

20. A flare pit igniter assembly according to claim 18 or claim 19, said assembly having a length of about 2–25 feet.

21. A flare pit igniter assembly according to claim 18 or claim 19, and including means for raising and lowering said boom.

22. A flare igniter assembly adapted for ignition within a burner tube, said assembly comprising:

an elongated tubing assembly of relatively noncorrodible metal attached to and positioned parallel to and in juxtaposition with said burner tube, said assembly including:

a first air supply conduit;

a fuel gas supply line enclosed within said first air supply conduit;

said fuel gas supply line being provided with a member having a venturi-type orifice through which fuel gas and intake air pass, said orifice effecting initial mixing of said fuel gas and air;

said fuel gas supply line further including a combustion zone;

means for transferring a fuel gas-air mixture downstream from said orifice to said combustion zone; said combustion zone including an inspirating baffle member firmly positioned within said fuel gas supply line; said baffle member being so constructed as to effect further thorough mixing of said fuel-gas mixture as it passes therethrough prior to combustion of said mixture in said zone; and a terminal portion inclined at an angle relative to the remainder of said fuel gas supply line;

a second air supply conduit extending parallel to said first air supply conduit and in juxtaposition therewith;

said terminal portion of said fuel gas supply line extending into said second air supply conduit within which an ignited flame is burning when said assembly is in operation;

said second air supply conduit being provided with a port hole in the wall opposite to said terminal portion of said igniter and adjacent to a corresponding port hole in the wall of said burner tube such as to enable flame from said terminal portion to pass therethrough to ignite combustible gases in said burner tube;

said second air supply conduit being provided for supplying said terminal portion with an additional amount of air, and for protecting the flame of said terminal portion against strong wind;

said igniter assembly being of sufficient length to ensure that air drawn into said first and second air supply conduits is substantially uncontaminated with waste gases and pollutants from the burner tube;

said assembly being retractable from a first operative position to a second inoperative position, and vice versa; and said assembly being provided with a down draft deflector plate for directing a pilot flame towards said burner.

* * * * *